US010352051B2

(12) United States Patent
Hardy

(10) Patent No.: US 10,352,051 B2
(45) Date of Patent: Jul. 16, 2019

(54) AUTOMATED GYPSUM BOARD INSTALLATION MACHINE

(71) Applicant: Jerry Hardy, Washington, DC (US)

(72) Inventor: Jerry Hardy, Washington, DC (US)

( * ) Notice: Subject to any disclaimer, the term of this patent is extended or adjusted under 35 U.S.C. 154(b) by 188 days.

(21) Appl. No.: 15/240,236

(22) Filed: Aug. 18, 2016

(65) Prior Publication Data

US 2017/0051518 A1 Feb. 23, 2017

Related U.S. Application Data

(60) Provisional application No. 62/206,707, filed on Aug. 18, 2015.

(51) Int. Cl.
*E04F 21/18* (2006.01)
*E04F 13/07* (2006.01)

(52) U.S. Cl.
CPC ..... *E04F 21/1805* (2013.01); *E04F 13/07* (2013.01); *E04F 21/1844* (2013.01)

(58) Field of Classification Search
CPC ... E04F 21/1805; E04F 21/1844; E04F 13/07; E04F 21/18; E04F 21/1811
See application file for complete search history.

(56) References Cited

U.S. PATENT DOCUMENTS 4,967,733 A * 11/1990 Rousseau ..... B66F 11/04 182/13
6,155,764 A * 12/2000 Russo ..... A41D 13/0007 224/221
2017/0114553 A1* 4/2017 Raman ..... E04F 21/18

* cited by examiner

*Primary Examiner* — Moshe Wilensky
*Assistant Examiner* — Kyle A Cook

(57) ABSTRACT

An automated gypsum board installation machine is a device for automatically positioning, installing, and fastening gypsum boards. The device includes a first extendable support member and a second extendable support member as well as a board-fastening assembly that is slidably engaged in between. A quantity of gypsum boards is held within a board-containing receptacle and a gypsum board may be moved into position by at least one adjustable board-retaining device. Once the gypsum board is positioned, at least one fastener-installing device is able to secure the gypsum board in place via fasteners. The at least one fastener-installing device is mechanically coupled to at least one fastener receptacle. The device may be controlled automatically or manually via a control unit and a wireless receiver.

6 Claims, 8 Drawing Sheets

AUTOMATED GYPSUM BOARD INSTALLATION MACHINE

The current application claims a priority to the U.S. Provisional Patent application Ser. No. 62/206,707 filed on Aug. 18, 2015.

FIELD OF THE INVENTION

The present invention relates generally to a device for installing gypsum panels, otherwise known as drywall. More specifically, the present invention is an automated gypsum board installation machine for automatically positioning, installing, and fastening gypsum boards.

BACKGROUND OF THE INVENTION

The use of gypsum boards, also known as drywall, has largely replaced traditional lath and plaster methods for building interior walls and ceilings. Traditional methods often require up to a week for the entire application to be completed. However, gypsum boards allow for an entire building to be drywalled relatively quickly. Gypsum boards may be used for both small and large scale construction processes. Gypsum boards additionally have a number of advantages including fire resistance, sound isolation, durability, and versatility. Because of their typically large size, gypsum boards are able to quickly cover large walls. However, the installation of gypsum boards is often quite tedious due to the fact that gypsum board installers must be hoisted up alongside a building, which can be dangerous at great heights.

The present invention is an automated gypsum board installation machine that enables automatic positioning, installation, and fastening of gypsum boards. The present invention may be programmed to automatically install the gypsum boards based on inputted settings. Alternatively, the present invention may be remotely operated and controlled.

DETAIL DESCRIPTIONS OF THE INVENTION

Figure 1:
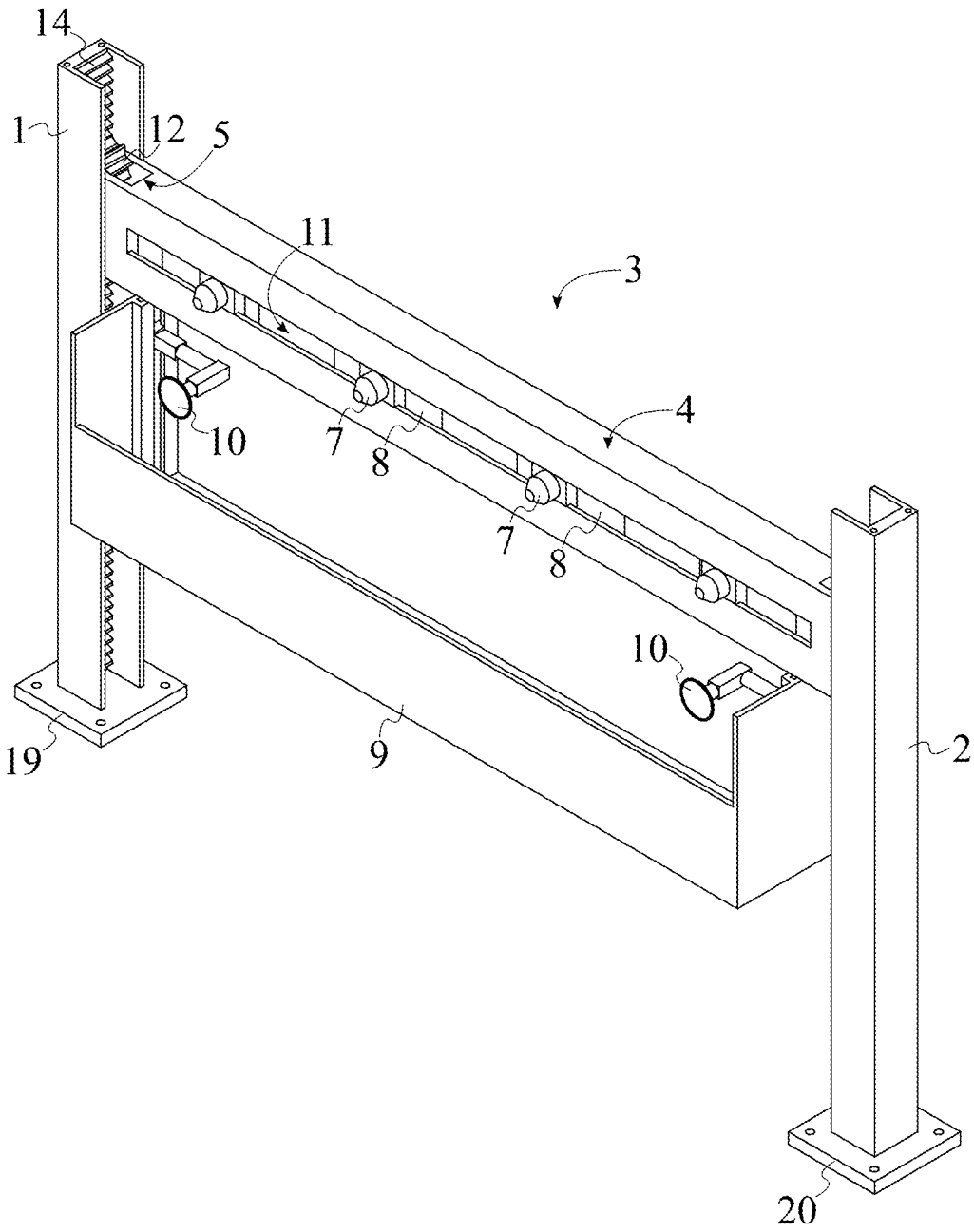
FIG. 1 is a front perspective view of the present invention.
Figure 2:
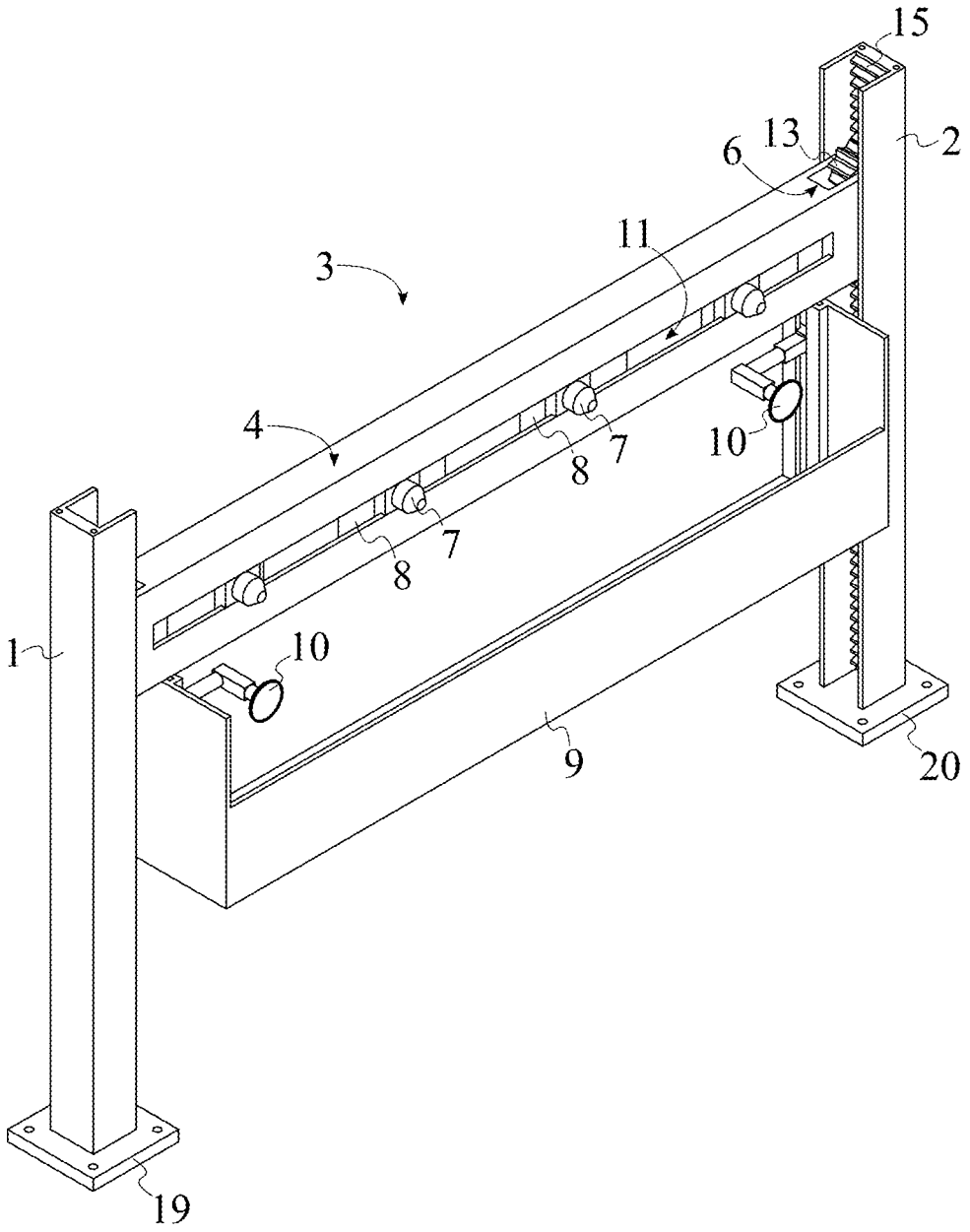
FIG. 2 is an additional front perspective view of the present invention.
Figure 3:
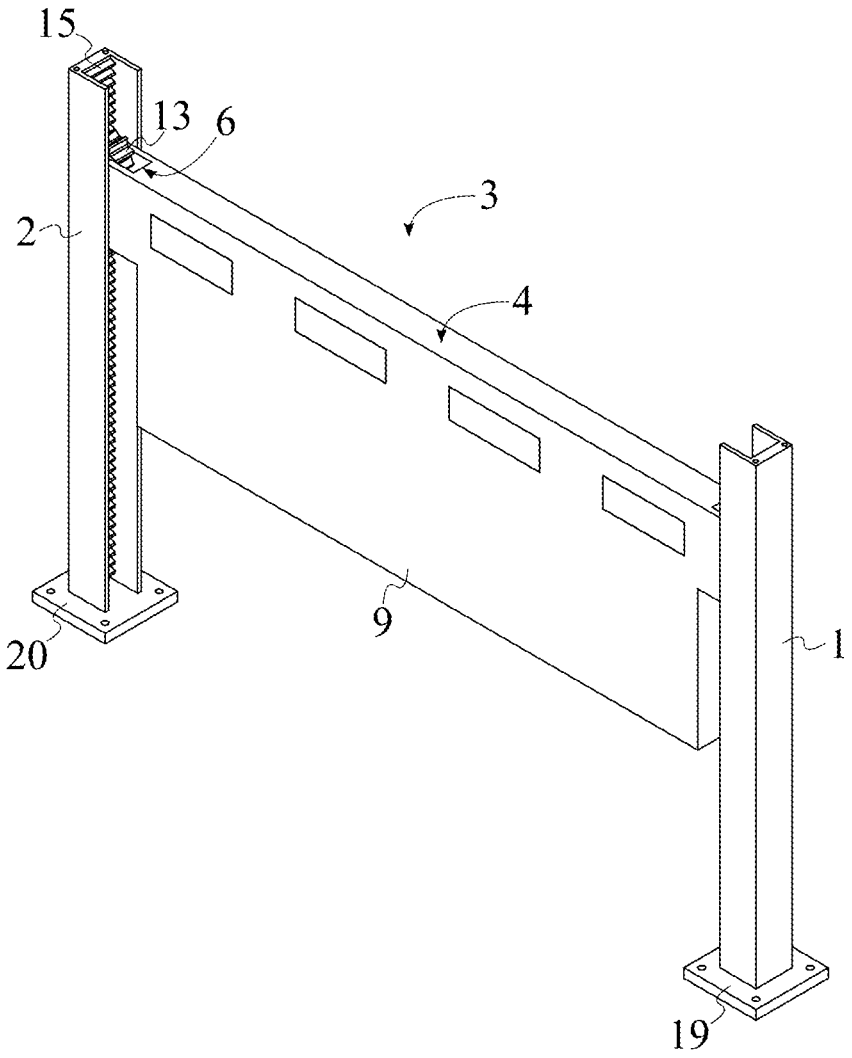
FIG. 3 is a rear perspective view of the present invention.

All illustrations of the drawings are for the purpose of describing selected versions of the present invention and are not intended to limit the scope of the present invention.

The present invention is an automated gypsum board installation machine for automatically positioning, installing, and fastening gypsum boards. The present invention is shown in FIGS. 1-6 and comprises a first extendable support member 1, a second extendable support member 2, and a board-fastening assembly 3.

The first extendable support member 1 and the second extendable support member 2 serve to hold the present invention upright during use and may be adjusted during the process of installing a gypsum board. The first extendable support member 1 and the second extendable support member 2 are oriented parallel to each other. The board-fastening assembly 3 is slidably engaged in between the first extendable support member 1 and the second extendable support member 2. As a result, the board-fastening assembly 3 is able to remain stable and slide linearly in between the first extendable support member 1 and the second extendable support member 2. By sliding along the first extendable support member 1 and the second extendable support member 2, the board-fastening assembly 3 may be moved to adjust the positioning of a gypsum board that is being installed. The movement of the board-fastening assembly 3 is controlled automatically (for example, by programming the present invention) or manually.

The first extendable support member 1 and the second extendable support member 2 may be extended or retracted as necessary in order to increase or decrease the height to which the board-fastening assembly 3 is able to reach. The present invention is not limited with respect to the specific mechanism through which the first extendable support member 1 and the second extendable support member 2 are able to extend or retract. However, it is important to note that the mechanism does not interfere with the ability of the board-fastening assembly 3 to slide in between the first extendable support member 1 and the second extendable support member 2.

The board-fastening assembly 3 comprises an elongated housing 4, at least one fastener-installing device 7, at least one fastener receptacle 8, a board-containing receptacle 9, and at least one adjustable board-retaining device 10. The elongated housing 4 serves as a base onto and into which the components of the board-fastening assembly 3 are positioned.

The at least one fastener-installing device 7 is able to secure a gypsum board that has been installed into place via fasteners. For example, the at least one fastener-installing device 7 may be a screw gun for installing drywall screws. The at least one fastener-installing device 7 is mounted to the elongated housing 4, allowing a gypsum board to be fastened in place after being installed. In the preferred embodiment of the present invention, the board-fastening assembly 3 further comprises an elongated slot 11. The elongated slot 11 enables the position of the at least one fastener-installing device 7 to be adjusted. The elongated slot 11 traverses into the elongated housing 4, forming a channel and track along which the at least one fastener-installing device 7 is able to move. The at least one fastener-installing device 7 is slidably engaged along the elongated slot 11, allowing positional adjustment of the at least one fastener-installing device 7. The at least one fastener-installing device 7 may be adjusted automatically or manually. The at least one fastener receptacle 8 is utilized to store fasteners for use by the at least one fastener-installing device 7. The at least one fastener receptacle 8 is mechanically coupled to the at least one fastener-installing device 7, allowing fasteners within the at least one fastener receptacle 8 to be fed into the at least one fastener-installing device 7. The present invention may further comprise sensors that enable the at least one fastener-installing device 7 to be aligned and positioned as needed before fastening a gypsum board in place.

The board-containing receptacle 9 holds a quantity of gypsum boards to be installed by the present invention. The board-containing receptacle 9 is fixed to the elongated housing 4 and as such is able to move according to the corresponding movement of the elongated housing 4 in between the first extendable support member 1 and the second extendable support member 2. In the preferred embodiment of the present invention, the board-containing receptacle 9 is connected along the elongated housing 4, allowing gypsum boards within the board-containing receptacle 9 to be easily removed and installed. The at least one adjustable board-retaining device 10 is able to grasp a selected gypsum board for installation. The at least one adjustable board-retaining device 10 is slidably engaged within the board-containing receptacle 9 and as such is able to maneuver the gypsum board into place. In the preferred embodiment of the present invention, the at least one adjustable board-retaining device 10 is able to slide, extend, retract, and otherwise be adjusted when positioning a gypsum board on a vertical wall.

In its preferred embodiment, the present invention further comprises a first set of gears 12, a second set of gears 13, a first gear track 14, and a second gear track 15. The first set of gears 12, the second set of gears 13, the first gear track 14, and the second gear track 15 allow the position of the board-fastening assembly 3 to be adjusted in between the first extendable support member 1 and the second extendable support member 2. The first set of gears 12 is rotatably mounted to a first end 5 of the elongated housing 4. Similarly, the second set of gears 13 is rotatably mounted to a second end 6 of the elongated housing 4, opposite to the first set of gears 12. The first set of gears 12 and the second set of gears 13 are thus able to rotate freely about the first end 5 and the second end 6 as the position of the board-fastening assembly 3 is adjusted in between the first extendable support member 1 and the second extendable support member 2. The first gear track 14 is longitudinally integrated along the first extendable support member 1 while the second gear track 15 is longitudinally integrated along the second extendable support member 2. The first gear track 14 and the second gear track 15 are thus positioned along the entire length of the first extendable support member 1 and the entire length of the second extendable support member 2, respectively. The first set of gears 12 is rotatably engaged to the first gear track 14 while the second set of gears 13 is rotatably engaged to the second gear track 15. As a result, the first set of gears 12 and the second set of gears 13 are able to travel along the first gear track 14 and the second gear track 15, respectively. The first gear track 14 and the second gear track 15 are thus able to prevent the board-fastening assembly 3 from separating from the first extendable support member 1 and the second extendable support member 2. Alternative embodiments of the present invention may utilize other mechanisms for adjusting the position of the board-fastening assembly 3 in lieu of the first set of gears 12, the second set of gears 13, the first gear track 14, and the second gear track 15.

Figure 4:
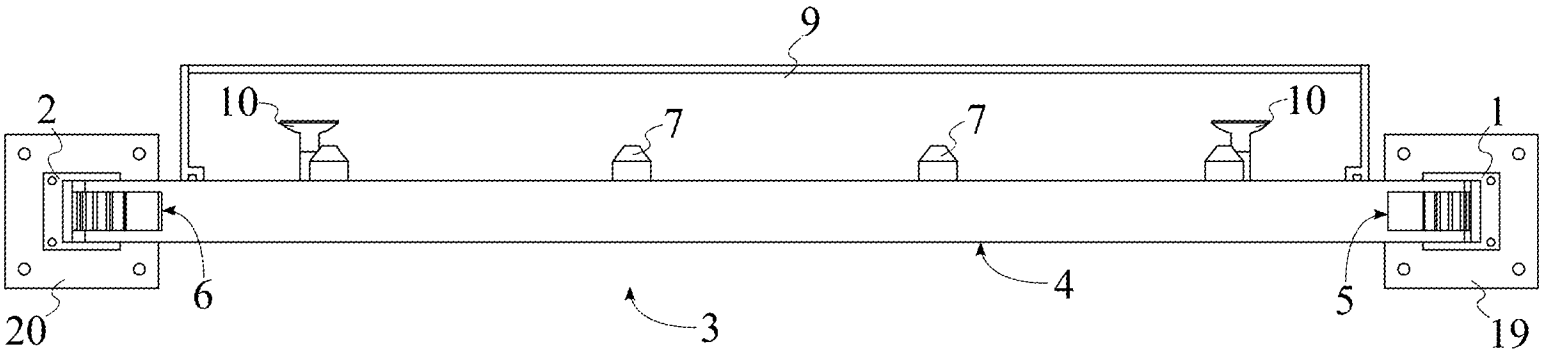
FIG. 4 is a top view of the present invention.
Figure 5:
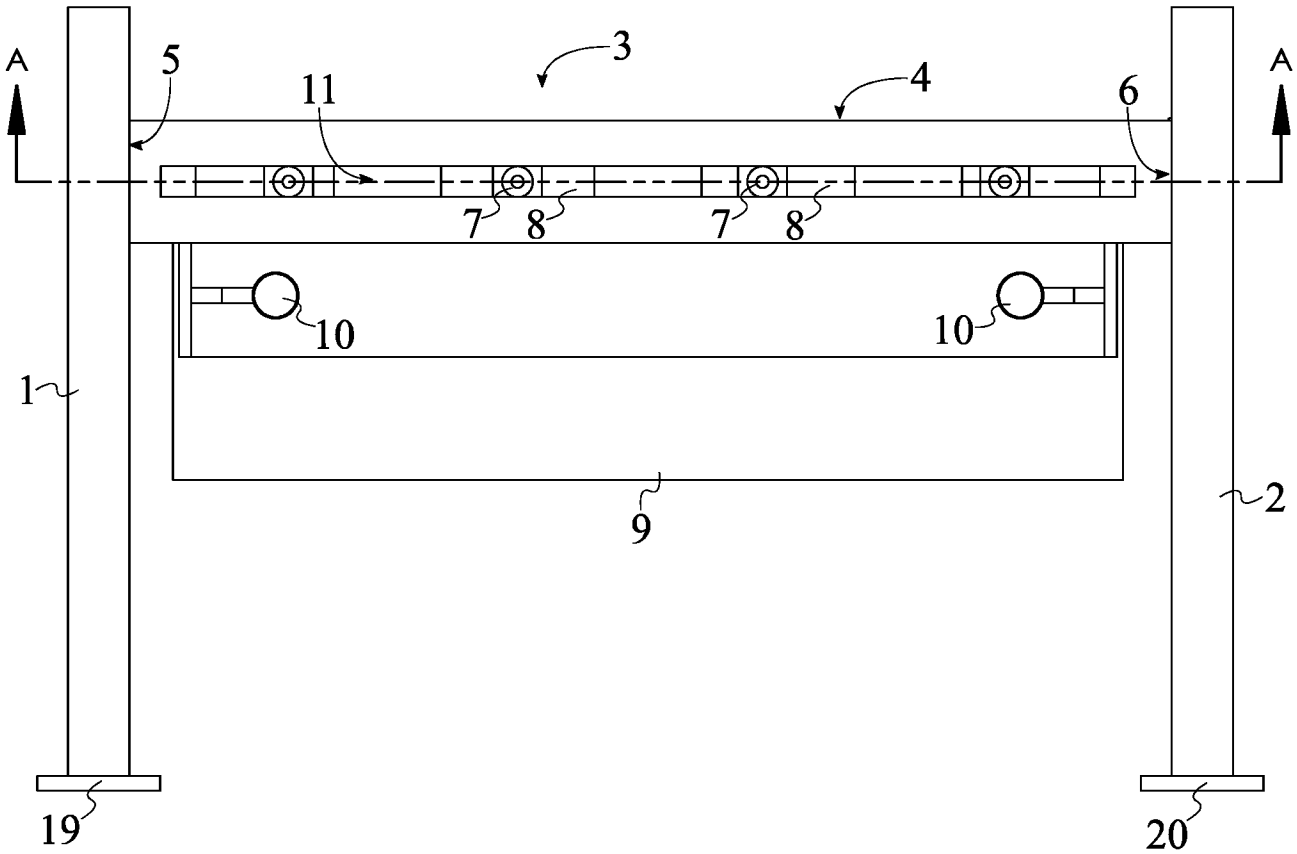
FIG. 5 is a front view of the present invention.
Figure 6:
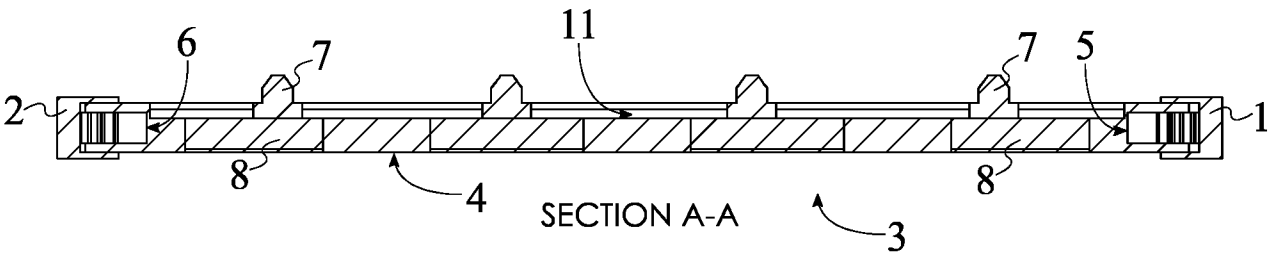
FIG. 6 is a cross-sectional view of the present invention taking along line A-A of FIG. 5.

As shown in FIG. 4, the first extendable support member 1 and the second extendable support member 2 are U-channels that into which the first gear track 14 and the second gear track 15 are integrated. The first set of gears 12 and the second set of gears 13 are thus positioned into the U-channels formed by the first extendable support member 1 and the second extendable support member 2, allowing the board-fastening assembly 3 to be moved.

Figure 7:
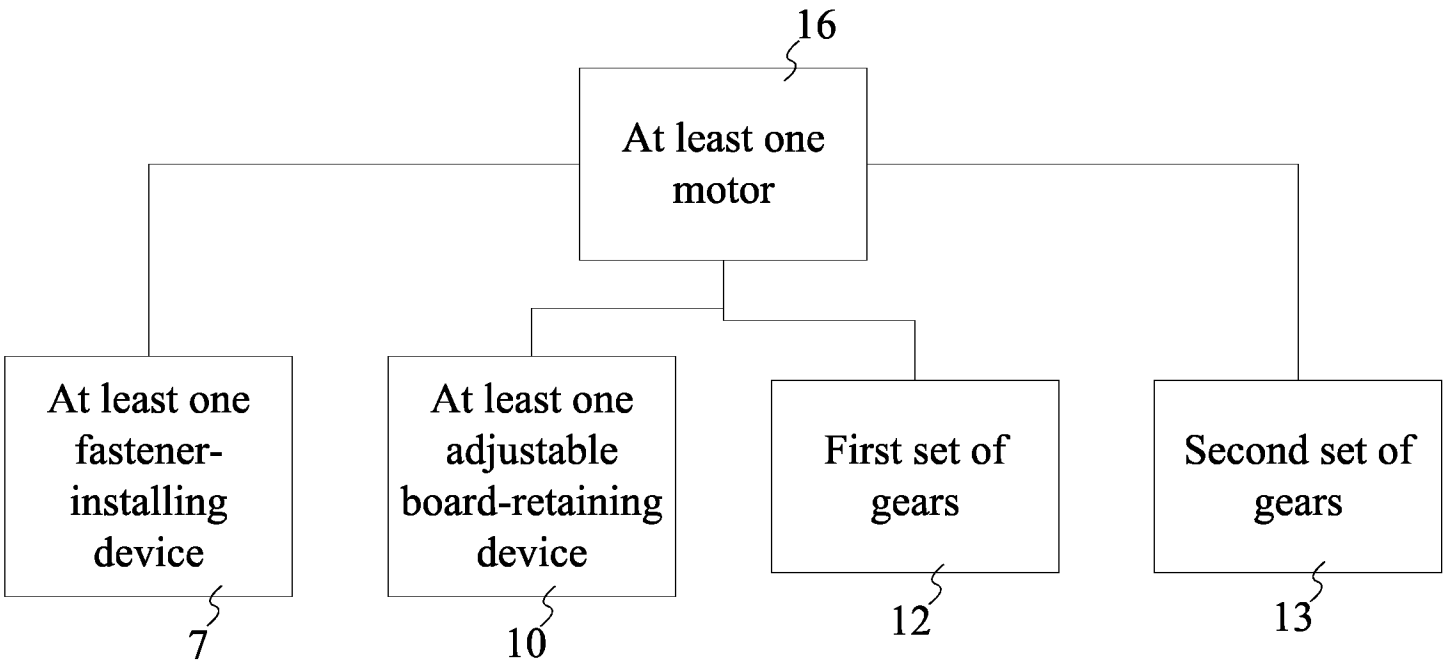
FIG. 7 is a diagram depicting mechanical couplings of the present invention.

With reference to FIG. 7, the present invention further comprises at least one motor 16. The at least one motor 16 enables the at least one fastener-installing device 7 and the at least one adjustable board-retaining device 10 to adjust position. As a result, the at least one fastener-installing device 7 may be moved to install fasteners in the desired positions on a gypsum board. The at least one adjustable board-retaining device 10 may be moved to position a gypsum board in the desired position as well. The at least one motor 16 additionally provides rotational motion to the first set of gears 12 and the second set of gears 13, enabling the board-fastening assembly 3 to be adjusted in between the first extendable support member 1 and the second extendable support member 2. The at least one motor 16 is mechanically coupled to the at least one fastener-installing device 7, the at least one adjustable board-retaining device 10, the first set of gears 12, and the second set of gears 13. The at least motor is thus able to transfer mechanical energy to the at least one fastener-installing device 7, the at least one adjustable board-retaining device 10, the first set of gears 12, and the second set of gears 13. In the preferred embodiment of the present invention, the at least one motor 16 comprises an individual motor for each of the at least one fastener-installing device 7, the at least one adjustable board-retaining device 10, the first set of gears 12, and the second set of gears 13.

Figure 8:
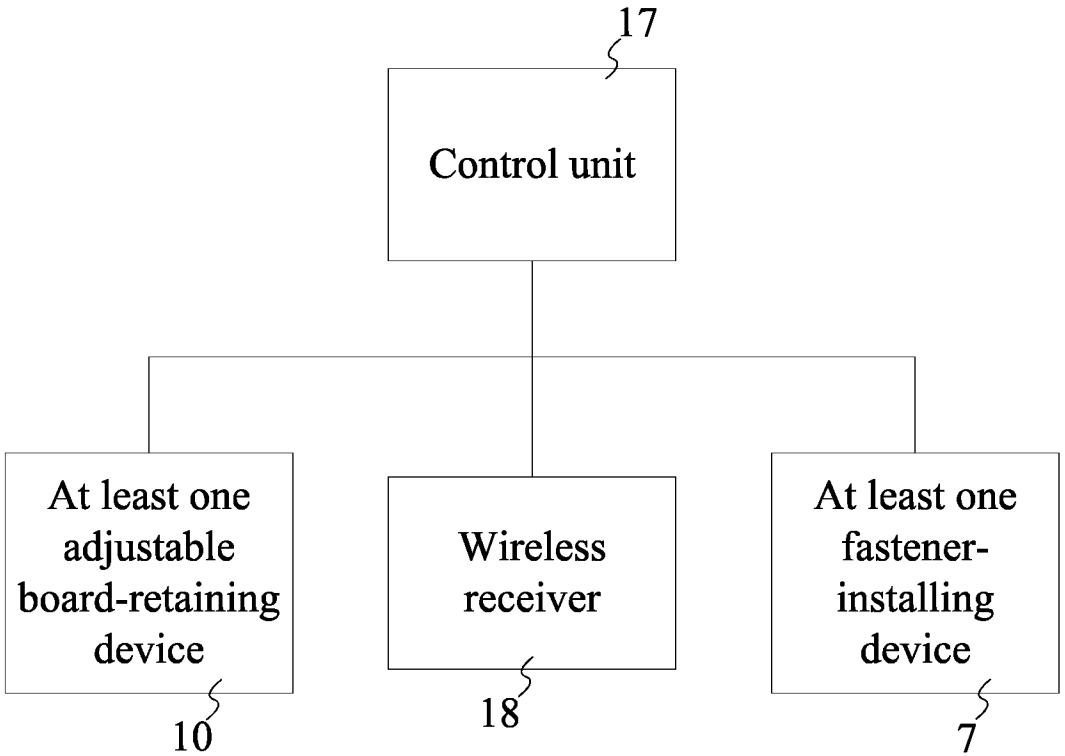
FIG. 8 is a diagram depicting electronic connections of the present invention.

With reference to FIG. 8, the present invention further comprises a control unit 17 and a wireless receiver 18 that are utilized to manage the operation of the present invention. The control unit 17 regulates the behavior of the present invention and processes commands for managing the present invention. The wireless receiver 18 enables the present invention to be remotely operated and is able to receive commands received remotely. The control unit 17 is electronically connected to the at least one fastener-installing device 7, the at least one adjustable board-retaining device 10, and the wireless receiver 18. As a result, commands are received through the wireless receiver 18, processed by the control unit 17, and then implemented through the at least one fastener-installing device 7 and the at least one adjustable board-retaining device 10.

In addition to remote control by the user, the control unit 17 may be programmed in order to automatically operate the present invention without any further input from the user. The present invention may further comprise sensors and/or cameras that are utilized during automatic operation of the present invention.

The present invention further comprises a first stabilizing base 19 and a second stabilizing base 20. The first stabilizing base 19 and the second stabilizing base 20 ensure that the present invention is fixed in place and stable during use. The first stabilizing base 19 is terminally connected to the first extendable support member 1 while the second stabilizing base 20 is terminally connected to the second extendable support member 2. The first stabilizing base 19 and the second stabilizing base 20 may thus be placed into contact with a surface and anchored in place in order to prevent the present invention from shifting or otherwise moving during use. In its preferred embodiment, the present invention is primarily intended for use on a hydraulic scaffolding platform or similar structure for allowing the present invention to be raised or lowered (for example, along the side of a building). The first stabilizing base 19 and the second stabilizing base 20 may be anchored into place via fasteners. In the preferred embodiment of the present invention, the orientation of the first stabilizing base 19 and the second stabilizing base 20 may be adjustable. For example, the first stabilizing base 19 and the second stabilizing base 20 may be attached to the first extendable support member 1 and the second extendable support member 2 in a manner such that the first stabilizing base 19 and the second stabilizing base 20 are able to swivel, pivot, and otherwise be adjusted.

The present invention may include an integrated power supply or a connection line that allows the present invention to be electrically connected to an external power source.

Although the present invention has been explained in relation to its preferred embodiment, it is understood that many other possible modifications and variations can be made without departing from the spirit and scope of the present invention as hereinafter claimed.

What is claimed is:

1. An automated gypsum board installation machine comprising:

a first support member;

a second support member;

a board-fastening assembly;

the board-fastening assembly comprising an elongated housing, at least one fastener-installing device, at least one fastener receptacle, a board-containing receptacle and at least one adjustable board-retaining device;

the first support member and the second support member being parallelly oriented to each other;

the board-fastening assembly being slidably engaged in between the first support member and the second support member;

the elongated housing being perpendicularly oriented to the first support member;

the elongated housing being perpendicularly oriented to the second support member;

the at least one fastener-installing device being mounted to the elongated housing;

the at least one fastener receptacle being mechanically coupled to the at least one fastener-installing device;

the elongated housing comprising a first elongated track, a second elongated track and an elongated slot;

the first elongated track and the second elongated track being parallelly oriented to each other;

the elongated slot being formed in between the first elongated track and the second elongated track;

each of the at least one fastener-installing device being slidably engaged with both of the first elongated track and the second elongated track;

each of the at least one fastener-installing device being slidably inserted into the elongated slot;

the board-containing receptacle being fixed to the elongated housing; and the at least one adjustable board-retaining device being slidably engaged within the board-containing receptacle.

2. The automated gypsum board installation machine as claimed in claim 1 comprising:

the board-containing receptacle being connected along the elongated housing.

3. The automated gypsum board installation machine as claimed in claim 1 comprising:

a first set of gears;

a second set of gears;

a first gear track;

a second gear track;

the first set of gears being rotatably mounted to a first end of the elongated housing;

the second set of gears being rotatably mounted to a second end of the elongated housing, opposite to the first set of gears;

the first gear track being longitudinally integrated along the first support member;

the second gear track being longitudinally integrated along the second support member;

the first set of gears being rotatably engaged to the first gear track; and the second set of gears being rotatably engaged to the second gear track.

4. The automated gypsum board installation machine as claimed in claim 3 comprising:

at least one motor; and the at least one motor being mechanically coupled to the at least one fastener-installing device, the at least one adjustable board-retaining device, the first set of gears, and the second set of gears.

5. The automated gypsum board installation machine as claimed in claim 1 comprising:

a control unit;

a wireless receiver; and the control unit being electronically connected to the at least one fastener-installing device, the at least one adjustable board-retaining device, and the wireless receiver.

6. The automated gypsum board installation machine as claimed in claim 1 comprising:

a first stabilizing base;

a second stabilizing base;

the first stabilizing base being terminally connected to the first support member; and the second stabilizing base being terminally connected to the second support member.

* * * * *